United States Patent [19]

de Cuadros

[11] Patent Number: 5,046,203

[45] Date of Patent: Sep. 10, 1991

[54] COLLAPSIBLE HAMMOCK SUPPORT

[76] Inventor: Graciela V. O. de Cuadros, 53-00 65 Place, Maspeth, N.Y. 11378

[21] Appl. No.: 582,413

[22] Filed: Sep. 14, 1990

[51] Int. Cl.[5] ..... A45F 3/24

[52] U.S. Cl. ..... 5/128; 135/95; 248/166

[58] Field of Search ..... 248/166, 165, 163.2, 248/370; 272/85, 88, 86, 87; 5/127, 128, 129, 130, 114; 135/95, 106, 117

[56] References Cited

U.S. PATENT DOCUMENTS

| | | | |
|---|---|---|---|
| 235,809 | 12/1880 | Price | 5/130 |
| 781,609 | 1/1905 | Lawson | 5/127 |
| 1,011,789 | 12/1911 | Hoffman | 5/128 X |
| 1,097,941 | 5/1914 | Rector | 5/128 X |
| 2,251,298 | 8/1941 | Spangler | 5/128 X |
| 2,353,220 | 7/1944 | Charlop | 5/128 |
| 4,229,845 | 10/1980 | Cuadros | 5/114 |
| 4,757,563 | 7/1988 | An | 135/95 |

*Primary Examiner*—J. Franklin Foss
*Attorney, Agent, or Firm*—Auslander & Thomas

[57] ABSTRACT

A collapsible hammock support that selectively receives a hammock. The hammock support includes a ground engaging hammock support frame assembly and a rotatably attached hammock shade support frame assembly. The shade support frame assembly can be disposed at various lateral dispositions to selectively orient a sunshade attached thereto.

9 Claims, 4 Drawing Sheets

COLLAPSIBLE HAMMOCK SUPPORT

BACKGROUND OF THE INVENTION

The present invention generally relates to a portable and collapsible support for a hammock. More specifically, the present invention relates to a collapsible hammock support having sun shading means.

In. U.S. Pat. No. 4,229,845 to the present applicant, a collapsible hammock support is disclosed, generally comprising first and second ground engaging support members having collapsible longitudinally extending bracing members and collapsible transversely extending bracing members disposed between the first and second ground engaging support members, and means for detachably connecting the respective ends of a hammock. The hammock support of the prior art does not provide collapsible means for shading a person seated or lying in the hammock. This limitation of the prior art collapsible hammock support is overcome by the present invention.

SUMMARY OF THE INVENTION

The present invention is a collapsible hammock support having collapsible sun shading means pivotally attached to the top portion of collapsible hammock support means. The hammock support generally comprises a collapsible hammock support frame assembly, a collapsible hammock shade support frame assembly having a sun shade attached thereto, means to pivotally attach the shade support frame assembly to the hammock support frame assembly at selective dispositions, and means to selectively attach a hammock to the hammock support.

The pivoting attachment means for the hammock shade support frame assembly and the selective attachment means for a hammock are combined into a singular mounting bracket having a hammock hook portion and a frame assembly's attachment portion. The hammock hook portion comprises a hook body having a hook bearing plate integrally formed to one end of said hook body, and a threaded opening extending from said hook bearing plate to within said hook body. The frame assembly's attachment portion comprises a frame assembly's bearing arm having a threaded attachment stem extending from one end of said frame assembly's bearing arm, the threads of said stem being complementary to the threads of the threaded opening of the hammock hook portion for threaded engagement therewith, and a frame assembly's bearing plate integrally formed at the opposite end of said frame assembly's bearing arm having a frame assembly's attachment portion turning knob integrally formed with said frame assembly's bearing plate.

An object of the present invention is to provide a portable support for a hammock.

It is also an object of the present invention to provide a collapsible hammock support having sun shading means.

A further object of this invention is to provide a hammock support having sun shading means that can be adjusted to various dispositions above the attached hammock.

Although such novel feature or features believed to be characteristic of the invention are pointed out in the claims, the invention and the manner in which it may be carried out, may be further understood by reference to the description following and the accompanying drawings.

BRIEF DESCRIPTION OF THE DRAWINGS

Referring now to the figures in greater detail, where like reference numbers denote like parts in the various figures.

DESCRIPTION OF A PREFERRED EMBODIMENT

Figure 1:
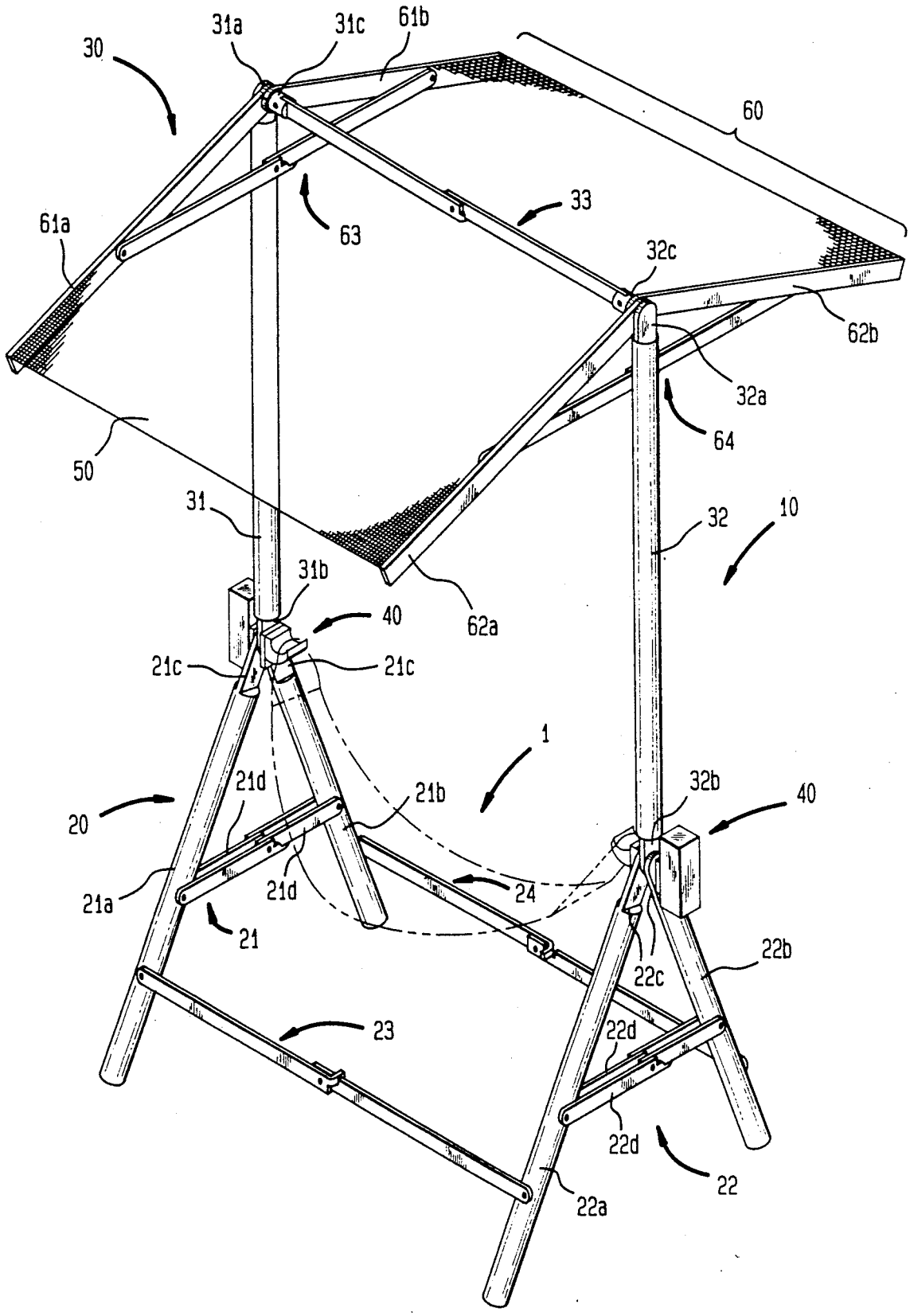
FIG. 1 is a perspective view of the collapsible hammock support of the present invention.

FIG. 1 illustrates in a perspective view the collapsible hammock support 10 of the present invention. A hammock 1 is shown in phantom lines as it would be disposed when attached to the hammock support 10. Hammock support 10 generally comprises a collapsible, ground engaging hammock support frame assembly 20 and a hammock shade support frame assembly 30 pivotally attached to the upper portion of the hammock support frame assembly 20 by means of a mounting bracket 40. A sunshade 50 is fixedly attached to the top of the hammock shade support frame assembly 30.

Collapsible hammock support frame assembly 20 comprises a first A-shaped collapsible structure 21 and a second A-shaped collapsible structure 22 which are collapsibly interconnected by first and second longitudinal bracing members 23, 24. The respective first and second A-shaped structures 21, 22 are formed by respective first and second tubular legs **21*a*, 21*b* and 22*a*, 22*b* having flat leg end members 21*c*, 22*c* which are pivotally attached to the mounting bracket 40 as hereinafter described in greater detail. Paired respective first and second transverse bracing members 21*d*, 22*d* are rotatably attached at the ends thereof to the respective first and second tubular legs 21*a*, 21*b* and 22*a*, 22*b*. Said first and second longitudinal bracing members 23, 24 are respectively attached between each of the first tubular legs 21*a*, 21*b* of the first A-shaped structure 21 and the respective second tubular legs 22*a*, 22*b* of the second A-shaped structure 22** in rotatable attachment at the ends thereof.

Figure 2:
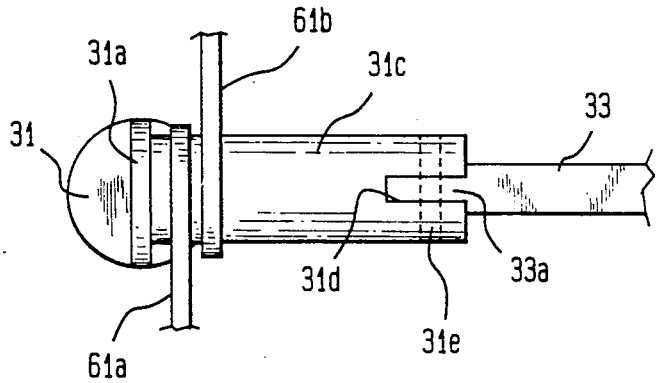
FIG. 2 is a fragmented top plan view of the bracing member stud of the hammock shade support frame assembly.
Figure 3:
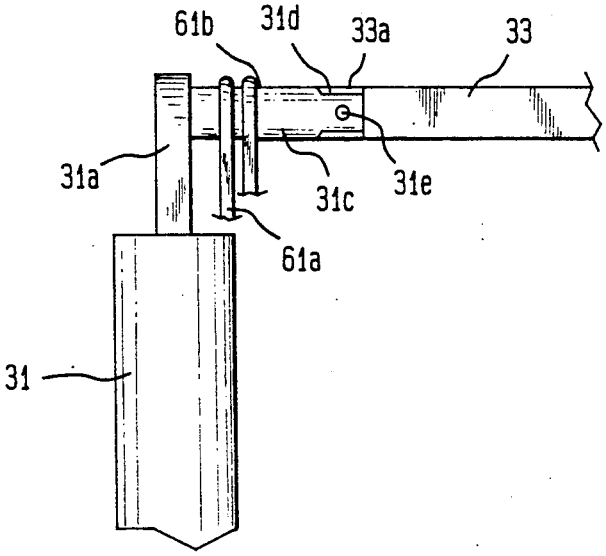
FIG. 3 is a fragmented side plan view of the bracing member stud of the hammock shade support frame assembly.

Hammock shade support frame assembly 30 comprises a first tubular arm 31 and a second tubular arm 32 which are collapsibly interconnected by a longitudinal shade bracing member 33, and a collapsible shade support subassembly 60 which supports the sun shade 50 in an outwardly extending position. The first and second tubular arms 31, 32 are formed having respective flat upper and lower end members 31*a*, 32*a* and 31*b*, 32*b*. The lower end members 31*b*, 32*b* are pivotally attached to the mounting bracket 40. The upper end members 31*a*, 32*a* have respective first and second shade bracing member studs 31*c*, 32*c* fixedly attached thereto, which are attached to the ends of the longitudinal shade bracing member 33. As can be best seen in the fragmented top plan view and the fragmented side plan view of the first shade bracing member stud 31*c*, shown in FIGS. 2 and 3, which is typical for said second shade bracing member stud 32*c*, said first shade bracing member stud 31*c* is a cylindrical member having a longitudinal stud slot 31*d* formed at the distal end thereof. An end portion 33*a* of the longitudinal shade bracing member 33 is rotatably received within the stud slot 31*d* and held therein by a stud dowel 31*e* which engages a slot formed in the first shade bracing member stud 31*c* and the shade bracing member end portion 33*a*.

Referring again to FIG. 1, it can be seen that collapsible shade support subassembly 60 comprises paired respective first and second transverse shade support members 61*a*, 61*b* and 62*a*, 62*b* which are rotatably attached at one end thereof to the first and second shade bracing member studs 31*c*, 32*c*, said paired first and second transverse shade support members 61*a*, 61*b* and 62*a*, 62*b* being collapsibly interconnected by respective first and second shade support bracing members 63, 64. The sunshade 50 is formed, preferably from a flexible nylon fabric and is fixedly attached at respective ends thereof to the top portions of said paired first and second transverse shade support members 61*a*, 61*b* and 62*a*, 62*b*. Sunshade 50 may alternatively be selectively attachable to said transverse shade support members 61*a*, 61*b* and 62*a*, 62*b* by snap fastener means or the like.

Figure 4:
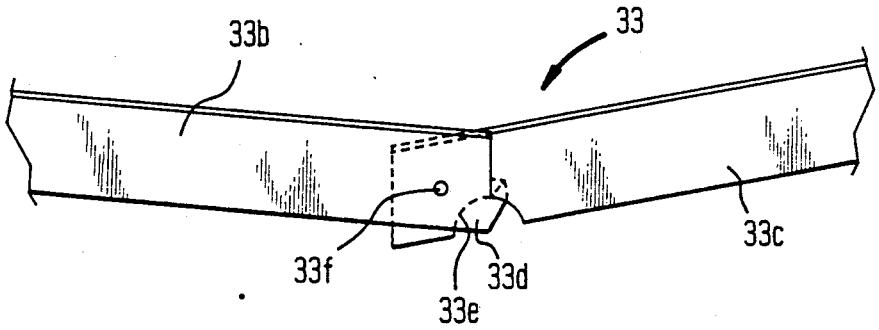
FIG. 4 is a fragmented side plan view of the central portion of the longitudinal shade bracing member.
Figure 5:
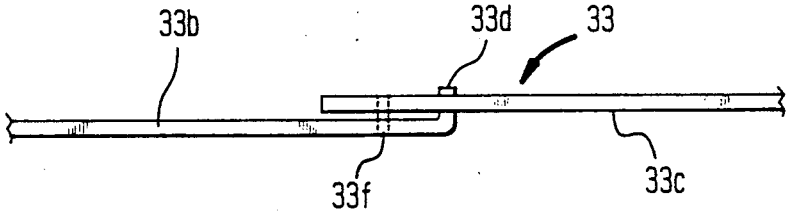
FIG. 5 is a top plan view of FIG. 4.

FIG. 4 illustrates in a fragmented side plan view the central portion of the longitudinal shade bracing member 33 which is the typical construction for the several bracing members 21*d*, 22*d*, 23, 24, 63 and 64. FIG. 5 is a top plan view of the shade bracing member 33 shown in FIG. 4. Shade bracing member 33 generally comprises first and second shade bracing member portions 33*b*, 33*c*. First shade bracing member portion 33*b* is an elongated member having an engagement tab 33*d* formed at the centrally disposed end thereof. Second shade bracing member portion 33*c* is an elongated member having an engagement slot 33*e* formed at the centrally disposed end thereof. Engagement tab 33*d* engages engagement slot 33*e* when the first and second shade bracing member portions 33*b*, 33*c* are disposed in the fully braced position. First and second shade bracing members 33*b*, 33*c* are held in pivotable engagement by bracing pin 33*f*.

Figure 6:
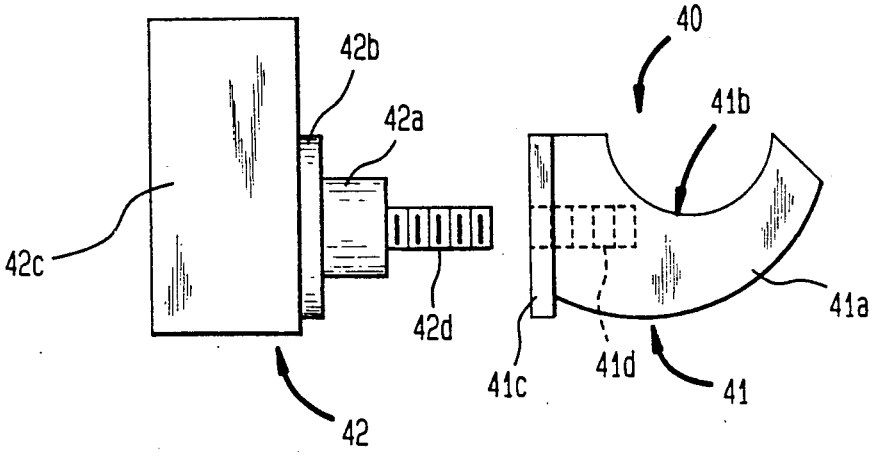
FIG. 6 is a side plan view of the mounting bracket of the present invention.

In the side plan view of the mounting bracket 40, illustrated in FIG. 6, it can be seen that mounting bracket 40 is a two part structure having a hammock hook portion 41 and a frame assembly's attachment portion 42. Hammock hook portion 41 includes a hook body 41*a* having a convexly curved top surface 41*b* which receives a hammock 1 in detachable engagement (FIG. 1). A hook bearing plate 41*c* is integrally formed to one side of the hook body 41*a*. A threaded opening 41*d* extends from the outside surface of the hook bearing plate 41*c* to within said hook body 41*a*. The threaded opening 41*d* is provided for threaded attachment of the frame assembly's attachment portion 42 to the hammock hook portion 41. Frame assembly's attachment portion 42 is formed having a frame assembly's bearing arm 42*a*, a frame assembly's bearing plate 42*b* integrally formed at one side of the frame assembly's bearing arm 42*a*, a frame assembly's attachment portion turning knob 42*c* integrally formed at the opposite side of the frame assembly's bearing plate 42*b*, and a threaded attachment stem 42*d* fixedly attached to the opposite side of the frame assembly's bearing arm 42*a*, the threads of said attachment stem 42*d* being complementary to the threads of said opening 41*d* formed in the hook body 41*a* for threaded engagement therein.

Figure 7:
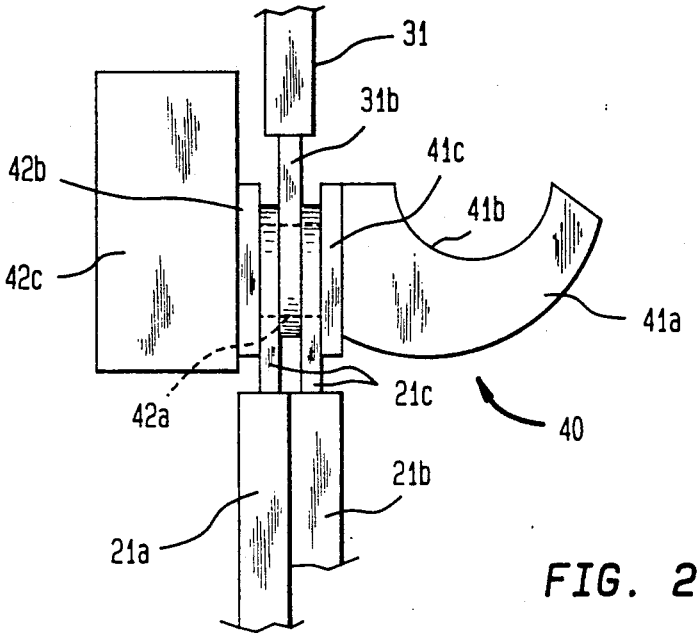
FIG. 7 is a side plan view of the mounting bracket having the hammock support frame assembly and the hammock shade support frame assembly attached thereto.

FIG. 7 illustrates in a side plan view the attachment of the first tubular arm 31 of the hammock shade support frame assembly 30 and the respective first and second tubular legs 21*a*, 21*b* of the first A-shaped structure 21 to the mounting bracket 40. The respective tubular arm 31 and tubular legs 21*a*, 21*b* include openings (not shown) formed in the respective lower end member 31*b* of the tubular arm 31 and the end members 21*c* of the first tubular legs 21*a*, 21*b* which receives in rotatable engagement the frame assembly's bearing arm 42*a*. The lower end member 31*b* of the tubular arm 31 is shown disposed between the end members 21*c* of the respective first tubular legs 21*a*, 21*b*; however, they may be attached to frame assembly's bearing arm 42*a* in any order.

To understand the collapsible and adjustable operation of the hammock support 10 of the present invention, reference is now made to FIG. 1 where the hammock support 10 is shown in its upright and braced position. The hammock shade support frame assembly 30 is held upright by the tight bearing engagement of the lower end member 31*b* of tubular arm 31 between the hook bearing plate 41*c* and the frame assembly's bearing plate 42*b* of the mounting bracket 40. The hammock shade support frame assembly 30 may be adjusted laterally to various positions by first loosening the frame assembly's attachment portion 42 of the mounting bracket 40 from the hammock hook portion 41 by rotating the turning knob 42*c*. Then the hammock shade support frame assembly 30 is repositioned as desired and the turning knob 42*c* is rotated in the opposite direction to hold the shade support frame assembly 30 in the new position. Thereby, the sunshade 50 can be oriented to guard against the sun in various positions of the sky or moved as the sun moves across the sky.

To collapse the hammock support 10 for transporting it to and from a beach or like area, the frame assembly's attachment portion 42 is loosened by rotation of the turning knob 42*c* and the central portion of the first and second transverse bracing members 21*d*, 22*d* are rotated to bring the first and second tubular legs 21*a*, 21*b* of the respective first and second A-shaped structures 21, 22 toward each other. The first and second shade support bracing members 63, 64 are likewise rotated to bring the respective paired first and second transverse shade support members 61*a*, 61*b* and 62*a*, 62*b* toward each other. The first and second tubular arms 31, 32 are then rotated about the frame assembly's bearing arm 42*a* to bring the hammock shade support frame assembly 30 adjacent to the hammock support frame assembly 20. The respective first and second longitudinal bracing members 23, 24 of the hammock support frame assembly 20 and the longitudinal shade bracing member 33 of the hammock shade support frame assembly 30 are rotated to bring the first and second A-shaped structures 21, 22 and the first and second tubular arms 31, 32 toward each other, thereby collapsing the entire hammock support 10. The turning knob 42*c* is then tightened to hold the hammock support frame assembly 20 and the hammock shade support frame assembly 30 in the collapsed position. It is preferred that the hammock 1 be detached from the hammock support 10 before collapsing it for transportation; however, hammock support 10 may be collapsed with the hammock 1 remaining attached. The hammock support 10 is set up in the upright position by reversing the steps described in the foregoing.

Figure 8:
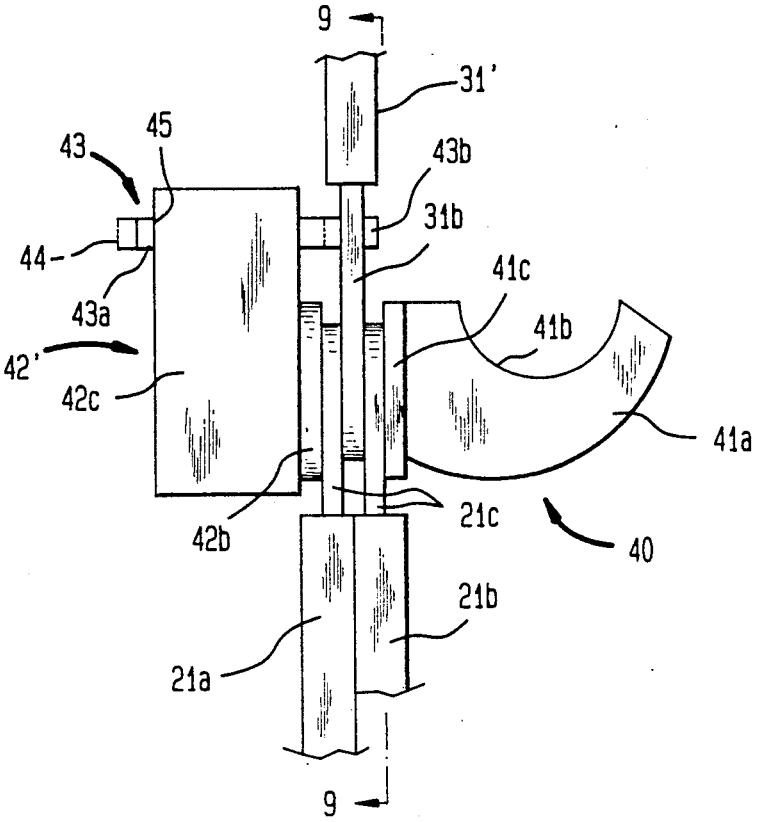
FIG. 8 is a side plan view of an alternative embodiment of the mounting bracket.
Figure 9:
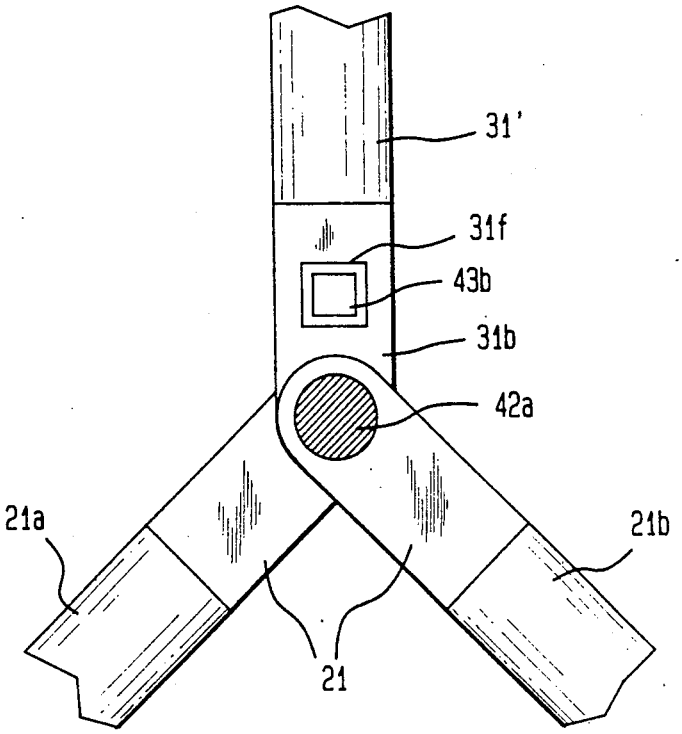
FIG. 9 is a cross sectional view taken along lines 9—9 of FIG. 8.

An alternative embodiment of the frame assembly's attachment portion 421 of the mounting bracket 40 and a complementary tubular arm 311 of the hammock shade support frame assembly 30 are shown in FIGS. 8 and 9. The alternative frame assembly's attachment portion 421 includes a selectively releasble finger 43 which includes a release button 43*a* and a finger extension 43*b*. The finger extension 43*b* is selectively moved transversely through the turning knob 42*c* by operation of the release button 43*a*, as known in the prior art, between a "release" position indicated by the numeral 44 and shown in shaded lines and a "lock" position indicated by the numeral 45 and shown in solid lines. In the "lock" position 45, the finger extension 43*b* engages a lock slot 31*f* formed in the lower end member 31*b* of the tubular arm 31, thereby locking the hammock shade support frame assembly 30 in an upright position.

The terms and expressions which are employed are used as terms of description; it is recognized, though, that various modifications are possible.

It is also understood that the following claims are intended to cover all of the generic and specific features of the invention herein described, and all statements of the scope of the invention which, as a matter of language, might fall therebetween.

Having described certain forms of the invention in some detail, what is claimed is:

1. An interconnected collapsible transportable hammock support including sunshade means comprising, an interconnected collapsible ground engaging hammock support frame assembly; comprising first and second A-shaped collapsible structures formed by respective first and second tubular legs having flat end members; and transverse bracing members being rotatably attached at ends thereof to the respective first and second tubular legs of the respective first and second A-shaped structures, an interconnected collapsible hammock shade support frame assembly, a flexible collapsible sunshade attached to said hammock shade support frame assembly, means to interconnectedly and pivotally attach said hammock shade support frame assembly to said hammock support frame assembly,.

means for selective attachment of a hammock to said hammock support, said means for selective attachment of a hammock to said hammock support comprising a mounting bracket having a hammock hook portion and a frame assembly's attachment portion.

2. A collapsible hammock support as in claim 1 wherein said sunshade is fixedly attached to said hammock shade support frame assembly.

3. A collapsible hammock support as in claim 1 wherein said sunshade is selectively attachable to said hammock shade support frame assembly.

4. A collapsible hammock support as in claim 1 wherein said sunshade is formed from a length of nylon material.

5. A collapsible hammock support as in claim 1 wherein said hammock shade support frame assembly comprises a first tubular arm and a second tubular arm formed having respective flat upper and lower end members, the upper end members having respective first and second shade bracing member studs fixedly attached thereto, said bracing member studs receiving in pivotal engagement a longitudinal shade bracing member and receiving in rotatable engagement a collapsible shade support subassembly, said first tubular arm and said second tubular arm being collapsibly interconnected by said longitudinal shade bracing member.

6. A collapsible hammock support as in claim 5 wherein said shade support subassembly comprises paired respective first and second transverse shade support members rotatably attached at one end thereof to said first and second shade bracing member studs, said paired first and second transverse shade support members being collapsibly interconnected by respective first and second shade support bracing members, said sunshade being attached at respective ends thereof to top portions of said first and second transverse shade support members.

7. A collapsible hammock support a in claim 6 wherein said means to pivotally attach said hammock shade support frame assembly to said hammock support frame assembly and said means for selective attachment of a hammock to said hammock support comprises a mounting bracket having a hammock hook portion and a frame assembly's attachment portion.

8. A collapsible hammock support as in claim 7 wherein said hammock hook portion comprises a hook body having a convexly curved top surface, a hook bearing plate integrally formed at one side of said hook body, and a threaded opening extending from the outside surface of said hook bearing plate to within said hook body; and wherein said frame assembly's attachment portion comprises a frame assembly's bearing arm, a frame assembly's bearing plate integrally formed at one side of said frame assembly's bearing arm, a turning knob integrally formed at the opposite side of the frame assembly's bearing plate, and a threaded attachment stem fixedly attached to the opposite side of the frame assembly's bearing arm;

said attachment stem being threadedly receivable in said threaded opening.

9. A collapsible hammock support as in claim 8 including means to interlock said hammock shade support frame assembly and said hammock support mounting assembly.

* * * * *